US005924143A

United States Patent [19]

Harrison

[11] Patent Number: 5,924,143

[45] Date of Patent: Jul. 20, 1999

[54] TOILET BOWL REFILL DEVICE

[76] Inventor: John Stanley Harrison, 7901 Wishing Well Rd., Las Vegas, Nev. 89123

[21] Appl. No.: 08/984,489

[22] Filed: Dec. 8, 1997

Related U.S. Application Data

[60] Continuation-in-part of application No. 08/571,141, Dec. 12, 1995, abandoned, which is a division of application No. 08/342,746, Nov. 21, 1994, Pat. No. 5,524,297.

[51] Int. Cl.[6] ..... E03D 1/34

[52] U.S. Cl. ..... 4/388; 4/393; 4/325

[58] Field of Search ..... 4/388, 392, 393

[56] References Cited

U.S. PATENT DOCUMENTS

| | | | |
|---|---|---|---|
| 419,566 | 1/1890 | Scott | 4/393 |
| 431,387 | 7/1890 | McHugh | 4/388 X |
| 2,879,521 | 3/1959 | Brasher | 4/388 |
| 5,157,796 | 10/1992 | Boyer et al. | 4/392 X |

*Primary Examiner*—Robert M. Fetsuga

[57] ABSTRACT

The refill device is used with water-saving flush valves which retrofit into existing toilet tanks. These valves normally do not allow enough time to refill the bowl to its proper level. This diminishes their effectiveness and efficiency. The refill device is depicted here on a two-level valve of the inventor's previous patent. It comprises a chamber (40) between a valve (20) and a plate (34) which rotate up off of an outlet (22). As the valve is lifted the chamber contracts. After upper float (28) or lower floats (66) allow the valve to drop, water pulling down on the valve draws water into the chamber. The water pulls a flap (54) shut over a hole (56) in the plate. The plate then supports the chamber which holds the valve slightly open, permitting a predetermined amount of water to flow under it to refill the toilet bowl. Water seeps under the flap at a controlled rate allowing the valve to completely close.

8 Claims, 5 Drawing Sheets

TOILET BOWL REFILL DEVICE

RELATED APPLICATIONS

This is a continuation-in-part of Ser. No. 08/571,141, filed Dec. 12, 1995, now abandoned, which was a division of Ser. No. 08/342,746, filed Nov. 21, 1994, now U.S. Pat. No. 5,524,297, granted Jun. 11, 1996.

FIELD OF THE INVENTION

This invention relates to toilet flush tanks. More specifically, it is a device to assist water-saving flush systems by refilling the toilet bowl to the proper level.

BACKGROUND

Numerous inventions have been proposed over the past one hundred years to reduce water consumption in toilets. They commonly use a mechanism that sustains the valve in an open position until the tank is partly drained. They then close the valve early to conserve the remaining water. Many of them have two flush levels. A short flush uses a small amount of water to flush out liquid waste. A longer flush drains most of the tank to flush out solid waste.

Despite the increasing need for water conservation, these water-saving flush valves have not had commercial success. This is because they nearly all have one common problem. They cause the toilet bowl not to refill to its normal level. This is due to the following two reasons:

a) In conventional toilets the rate of flow decreases gradually as the tank empties. When the flow rate becomes too slow the flushing action stops. The valve is not yet closed and the remaining water coming down from the tank contributes to refilling the bowl. In contrast, water-saving valves close quickly while the flow is still strong. No more water comes down to help refill the bowl. The momentum of water in the bowl and the siphoning action pull nearly all the water out of the bowl.

b) The bowl is normally refilled from the same ball cock that refills the tank. The refill water runs through a small hose from the ball cock to the top of the overflow tube. Less time is required to refill a partly empty tank after a water-saving flush than is required to refill an empty tank. Therefore there is less time available to refill the bowl.

A properly-filled toilet bowl is not just for looks. When the bowl has less water in it the toilet does not flush as well as it otherwise could. The first portion of water coming down from the tank only fills the bowl up to the level of the siphon. By the time water starts running out the siphon there is less water in the tank. The tank is draining more slowly. With the flow rate slower, a larger quantity of water is required to start the siphoning action which causes the flush. Overall, the toilet is then less efficient. If the flow rate is too slow or too short the siphoning action will not start at all. The toilet will not flush and the contents of the bowl are only diluted.

Very few of the previous water-saving inventions have proposed a method for refilling the bowl to its proper level. The methods that were proposed were too complex and expensive. A professional would be needed to install them. An example of this is U.S. Pat. No. 3,744,064 (Preston, Jul. 10, 1973). It uses two specialized control valves along with an array of tubes and a piston.

A simple method was proposed in U.S. Pat. No. 4,922,556 (Roosa, May 8, 1990). It uses a small hole in the overflow tube near the top. After the ball cock shuts off water continues to run through the hole to refill the bowl. The hole must be about two inches below the highest water level to allow sufficient water to refill the bowl. However, most ball cocks will turn back on before the water gets that low. Methods like this are unreliable for another reason. If pressure at times becomes too low in the supply line, water runs through the hole as fast as the tank is refilled. The water level never gets high enough to shut off the ball cock and the water runs continuously.

A ball cock could be made to divert more water through the hose to the overflow tube to refill the bowl. It could be sold with the new water-saving flush valve. However that would greatly increase the cost of the water-saving system. It would also be more troublesome to install. It would waste water on two-level systems by sending too much water to the bowl during the longer flush.

HISTORY OF THIS INVENTION

The present inventor previously patented a water-saving flush valve (U.S. Pat. No. 5,524,297, Jun. 11, 1996). It is a simple and inexpensive valve that easily retrofits into nearly any tank. It avoids the cost of replacing a 3, 5, or 7 gallon toilet with a new 1.6 gallon toilet. It has both a short flush that saves a half tank of water and a long flush that drains most of the tank. To refill the toilet bowl it includes a device called a delayer. The delayer comprises a small dashpot which delays the final closing of the valve. It holds the valve slightly open a few seconds to allow water to flow under it to refill the bowl. It can be used on other water-saving flush valves as well.

Since the time of that patent application, the inventor has made a number of improvements in the device. These improvements maintain the same simplicity that exists in the original concept. The improvements are as follows:

The delayer is located directly on top of the flush valve. This allows it to operate in small tanks without hitting the sides of the tanks, mounting bolts on the tank bottom or on the ball cock float. It can be installed without rotating the outlet and overflow tube to create more room.

The delayer is wide in relation to its height. This increases the volume change as it expands. It also reduces the pressure in the delayer so that its parts do not need to be as strong.

An edge of the top of the delayer is hinged to the flush valve. This allows the valve to support the top to minimize deflection in frame members so that they can be smaller. It prevents twisting and shifting of the delayer. It also causes the current to keep the delayer contracted until the valve reaches its slightly-open position.

The flexible sides of the delayer have a wide, rounded shape that allows it to expand and contract easily. This prevents the valve from sticking open when there is hardly any pressure on it.

The same opening which allows water to exit the delayer also serves to control the rate at which water enters. The rate is somewhat constant for varying water pressures. It eliminates the need for a separate, minute-size control hole that can clog from dirt particles in the water.

A simple flap is used for the control opening. It is dependable and is designed so that it will not stick shut

OBJECTS AND ADVANTAGES

Thus the objects and advantages of this invention are:

a) to provide for the refill of the toilet bowl in order to make water-saving flush valves more efficient and more likely to be installed.

b) to allow quick installation with the water-saving device without additional effort or special skill.

c) to provide a device that easily retrofits into any flush tank.

d) to provide a device that is very inexpensive.

e) to provide a device that is dependable and durable.

f) to not interfere with the water-saving flush valve, causing it to stick open, leak, or malfunction.

g) to require no direct manual operation.

h) to adjust to the differences of various toilets.

i) to function with both cycles of two-level flush valves.

Further objects and advantages of this invention will become apparent from a consideration of the drawings and ensuing description.

DRAWING FIGURES

DESCRIPTION OF THE PREFERRED EMBODIMENT

Figure 1:
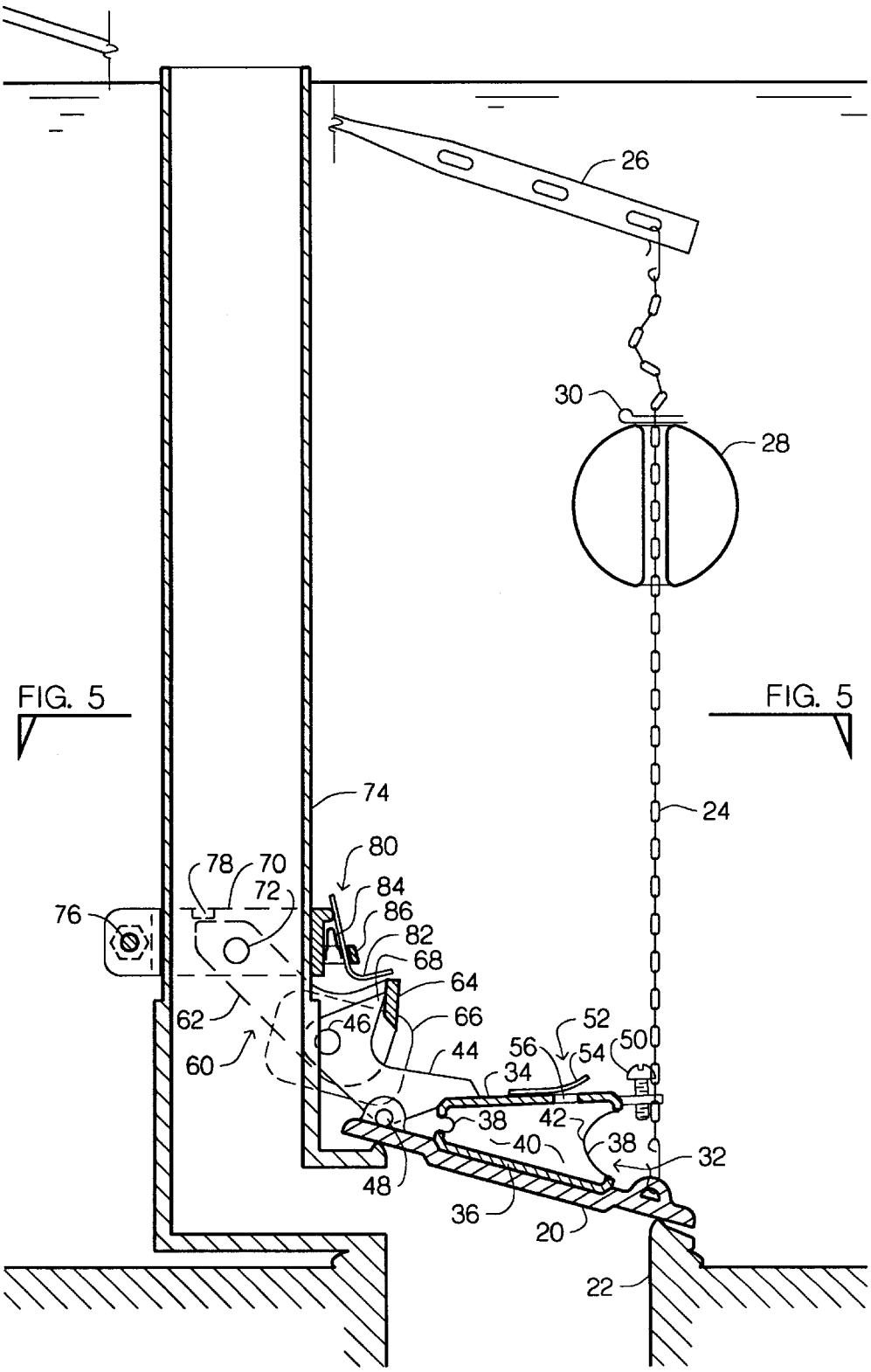
FIG. 1 is a section through the valve assembly in a closed position.

FIGS. 1 through 5 show the improved delayer used with the two-level flush valve of the inventor's pervious U.S. Pat. No. (5,524,297). It can also be used with many other types of water saving flush valves.

A non-buoyant valve 20 seats on a conventional outlet 22 of a toilet flush tank. It is connected to a chain or pull cord 24 which is connected to a typical lift arm 26. Lift arm 26 is fastened to a conventional flush handle (not shown) of a flush tank. An upper float 28 is attached to pull cord 24 with clip 30, so that the height of upper float 28 can be adjusted.

A delayer 32 on valve 20 comprises a plate 34 forming one end and a valve stiffener 36 forming another end. Flexible sides 38 extend between them. They form an envelope around chamber 40. Sides 38 have an inner circumference 42. The outer edges are adhesively attached and sealed to plate 34 and to valve stiffener 36 to make chamber 40 water tight. Valve stiffener 36 is attached to valve 20. Plate 34 is rigidly attached to arms 44 which are rotably attached at pins 46. Plate 34 and arms 44 rotate between a first position shown in FIGS. 1 & 3 and a second position shown in FIG. 2. Valve stiffener 36 is rotably attached to arms 44 at hinges 48, allowing it and valve 20 to rotate between the closed position shown in FIG. 1 and the position shown in FIG. 2 & 3, adjacent plate 34. An adjustment screw 50 limits how far valve 20 can rotate.

A control opening 52 in chamber 40 comprises an elastomeric flap 54 rigidly fastened to plate 34. Flap 54 is slightly above hole 56 in plate 34 when at rest. Flap 54 has a rectangular trough 58 (FIG. 6) in its bottom side.

Pins 46 are attached to a carriage 60. Carriage 60 comprises frame 62 and crossbar 64. Lower floats 66 are attached to frame 62. Tabs 68 prevent delayer 32 and valve 20 from rotating below carriage 60. Carriage 60 is rotably attached to a cincture 70 by mounting pins 72. Cincture 70 is rigidly fastened to the usual overflow tube 74 of a toilet tank by screw 76. Carriage 60 rotates between a position shown in FIGS. 1, 2, & 3 and a position shown in FIG. 4. Stops 78 prevent it from dropping below its lower position when plate 34 its in its second position (FIG. 2).

A latch 80 holds carriage 60 in its lower position. It comprises a spring 82 which is fastened to cincture 70 by a light spring 84. A brace 86 limits the movement of spring 82.

Operation of the Preferred Embodiment

Figure 2:
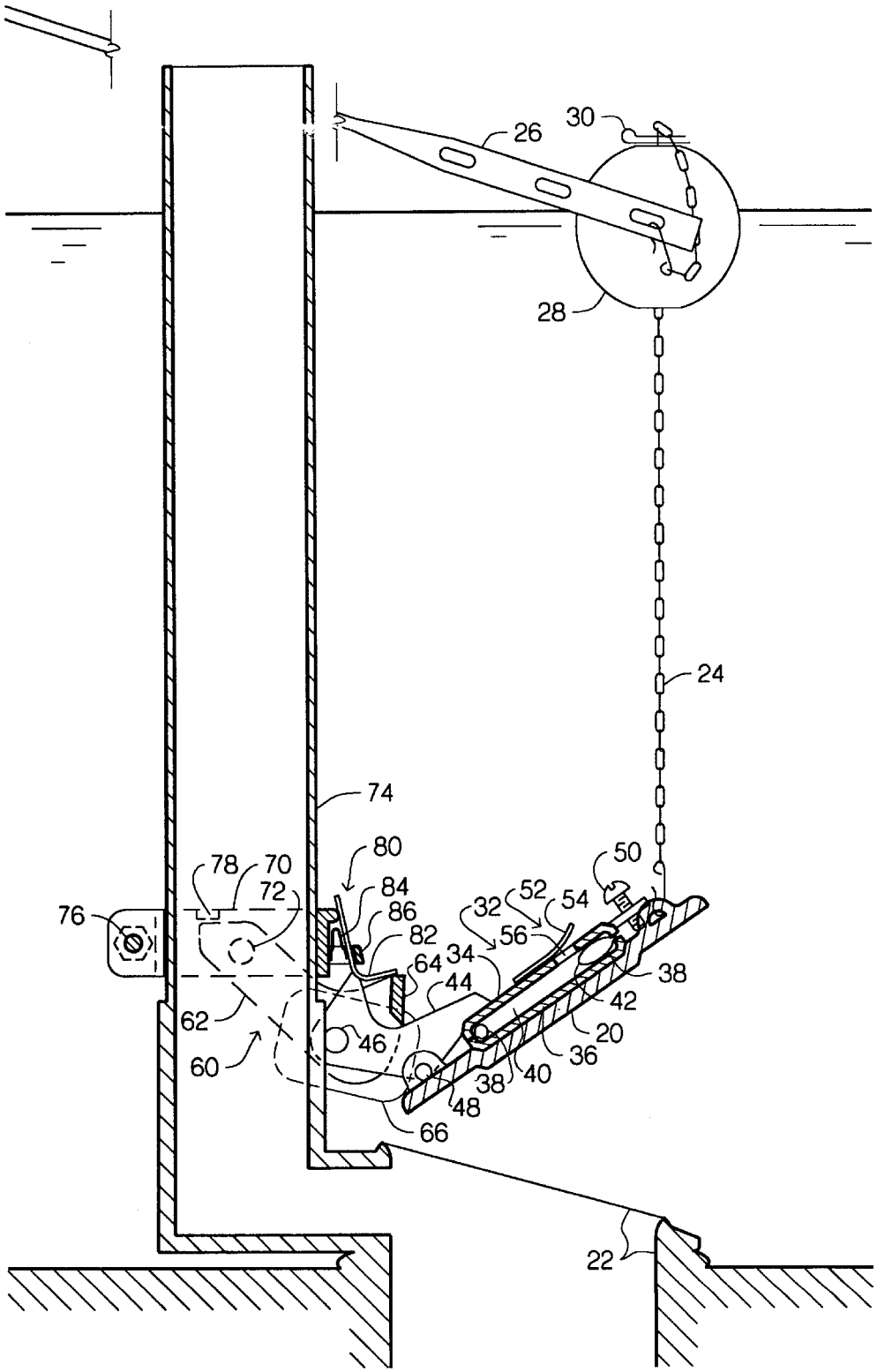
FIG. 2 is a section through the valve assembly during a short flush.

Depressing the flush handle (not shown) raises lift arm 26 which pulls valve 20 to the open position shown in FIG. 2. Latch 80 prevents carriage 60 from floating up. As valve 20 is raised water flowing around plate 34 pushes it downward, contracting chamber 40 to its first volume. Static water pressure under flap 54 is equal to static pressure above it. Thus flap 54 is moved only by the flow of water about it Because flap 54 is near the center of plate 34 there is hardly any downward flow around it. The water flows outward and around the edges of plate 34. Since hole 56 is small compared to the length and width of chamber 40, water flows rapidly out through hole 56, bending flap 54 upward as chamber 40 contracts. In this situation hole 56 acts as a relief opening by relieving pressure inside chamber 40. Upper float 28 continues to sustain valve 20 open and plate 34 in its second position, as shown in FIG. 2, while water flows from the tank through outlet 22.

After the water level drops to the level of upper float 28, upper float 28 drops with it. This allows valve 20 to drop to a slightly-open position and plate 34 to its first position, shown in FIG. 3. The main flow of water stops, thus ending the flush and conserving a large portion of water in the tank. The momentum of the water and siphoning action from the fast flow carry water out of the toilet bowl. It is left momentarily empty.

Figure 3:
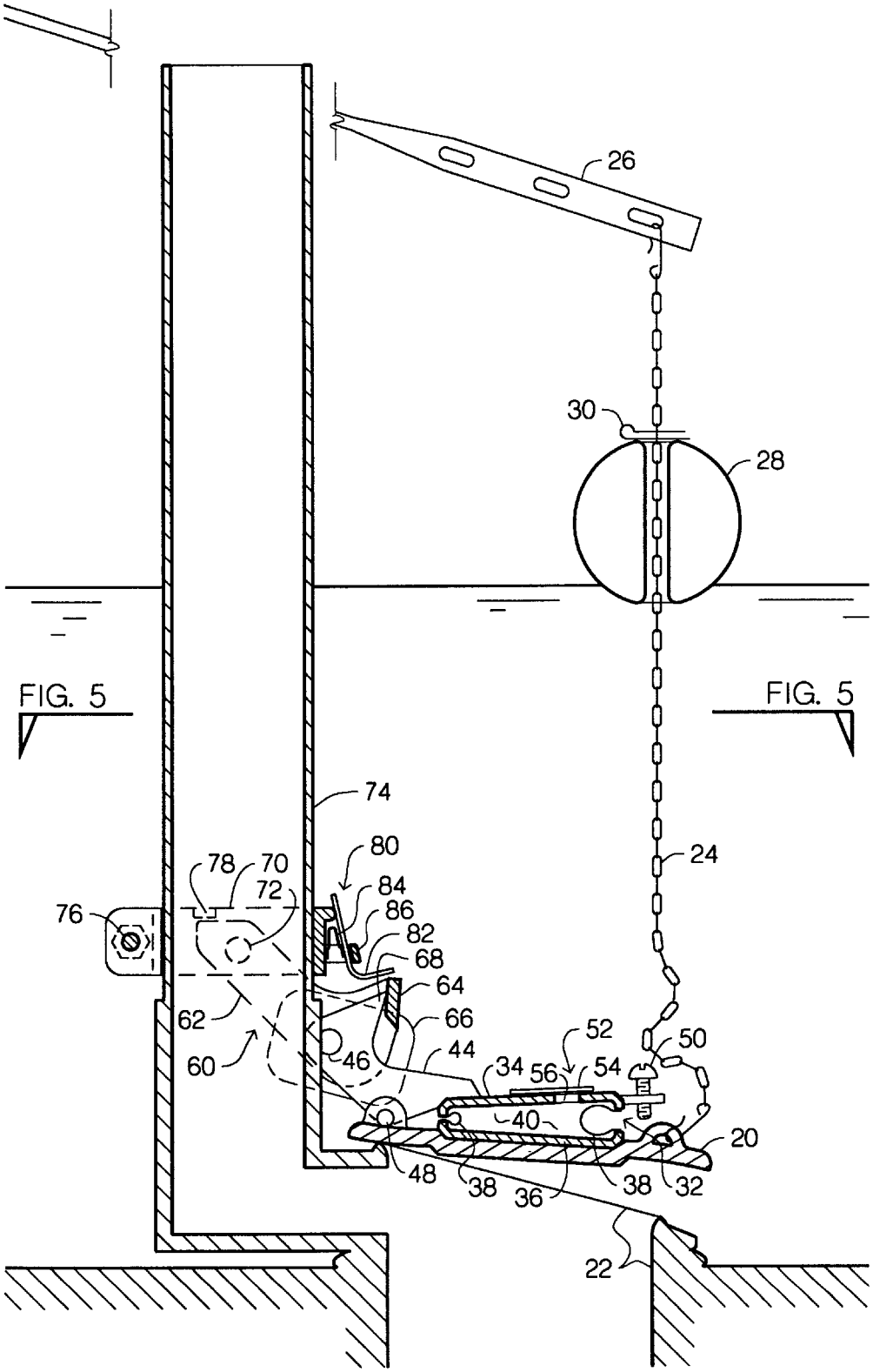
FIG. 3 is a section through the valve assembly in a slightly-open position.
Figure 4:
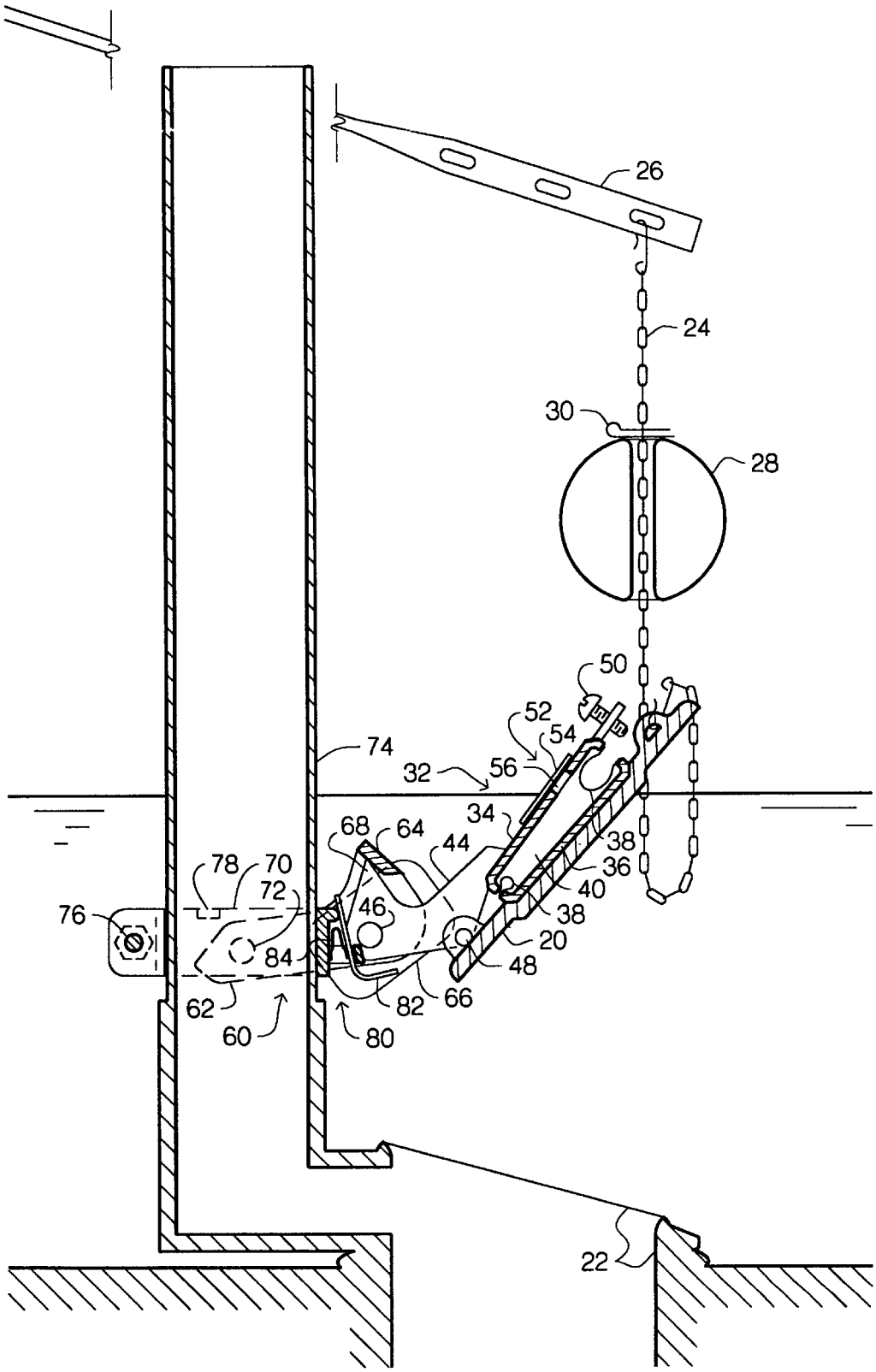
FIG. 4 is a section through the valve assembly during a long flush.
Figure 5:
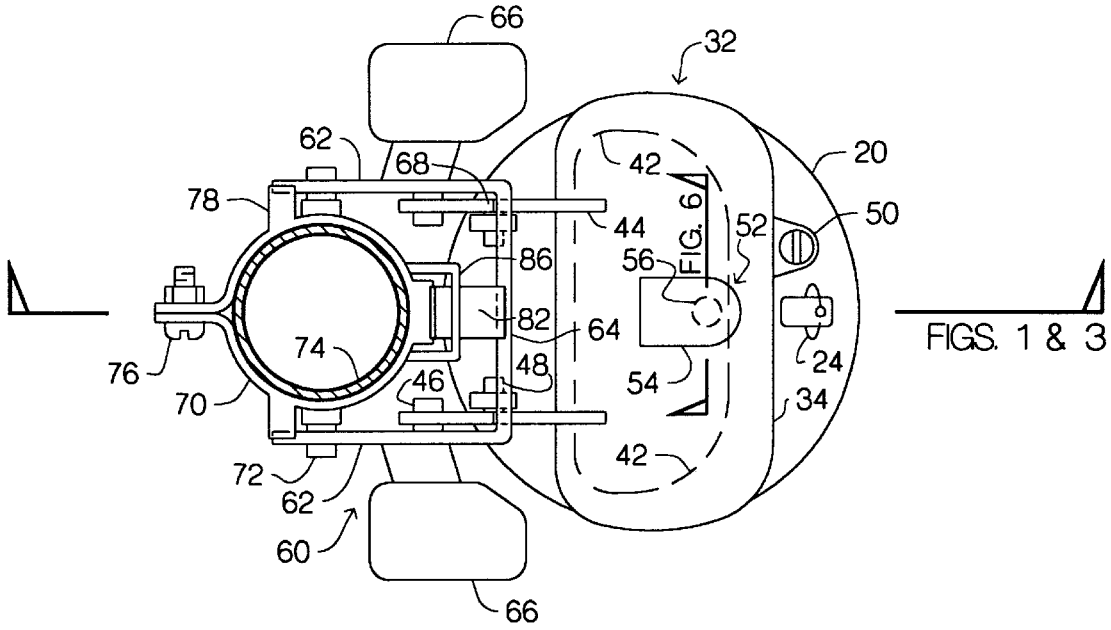
FIG. 5 is a plan view of the valve assembly.

As valve 20 and plate 34 are dropping the water flows faster around the back edge of valve 20 (the edge towards overflow tube 74) then around the front edge. This is because the back edge is closer to outlet 22 and hangs out over it (FIG. 2). That causes the back edge to try to fall faster than the front edge. Also upper float 28 drags the front edge. The back edge pulls down on arms 26 and plate 34 causing a leverage that holds plate 34 adjacent valve 20. This keeps chamber 40 completely contracted until the back edge hits outlet 22 (FIG. 3).

Outlet 22 then supports the back edge of valve 20 and hinges 48. These and pins 46 provide support for arms 44 and plate 34 in its first position. As valve 20 tries to close farther, water is sucked into chamber 40 through control opening 52. Because control opening 52 is small compared with the size of chamber 40, there is a fast flow into it. The water must flow around the edges of flap 54 which pulls it down to plate 34. Because flap 54 is dose to plate 34 in its resting position, as shown in FIGS. 1 and 2, it doses quickly before chamber 40 can expand much. Water pressure pushing down on valve 20 causes it to try to expand chamber 40. This causes a negative pressure inside chamber 40. This pressure continues to hold flap 54 against plate 34. Valve stiffener 36 prevents valve 20 from bulging up in the center. Water seeps in under flap 54 at a controlled rate, allowing chamber 40 to slowly expand and valve 20 to close completely. While valve 20 is closing water flows under it through outlet 22 to refill the toilet bowl to its normal level. After valve 20 has completely closed (FIG. 1) water pressure inside chamber 40 equalizes to outside pressure allowing flap 54 to re-open due to its elasticity.

To achieve a longer flush, the user presses the flush handle down farther which lifts valve 20 higher. This pulls carriage 60 up and disengages it from latch 80. Carriage 60 floats up to the position shown in FIG. 4. After upper float 28 drops, lower floats 66 continue to hold carriage 60 up which sustains valve 20 in an open position. As the water level drops farther the effective weight of partially submerged valve 20, plate 34, and carriage 60 overcome the buoyancy of lower floats 66. Valve 20 drops to its slightly-open position and pushes carriage 60 into its lower position (FIG. 2) where it easily re-engages in latch 80.

During the long flush, flap 54 closes at the time that upper float 28 drops. This is because water flowing around valve 20 tries to pull it down while carriage 60 holds plate 34 up. Chamber 40 starts to expand at this point and is partially expanded when valve 20 reaches outlet 22. This gives delayer 32 a head start which helps to compensate for the slow rate of expansion of chamber 40 due to the low pressure on valve 20 after a long flush.

Figure 6:
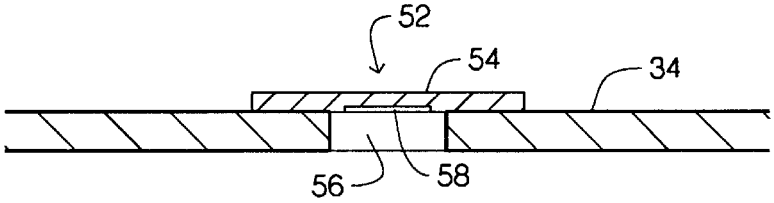
FIG. 6 is a detail section through the control opening.

After a long flush there is much less pressure on valve 20 than after a short flush. If the water were sucked into chamber 40 through a constant-size opening, the flow rate would be either much too slow after the long flush or much too fast after the short flush. In the arrangement shown in FIG. 2, flap 54 tries to bend itself back up to its initial position (FIG. 1). Low water pressure does not hold flap 54 as tightly against plate 34. This lets the water seeps in under flap 54 more quickly. To achieve an even more constant flow rate into chamber 40, flap 54 has a rectangular trough 58 in its bottom side (FIG. 6). Trough 58 has a minute depth. A high water pressure presses the center of trough 58 against plate 34. This leaves the small square corners of trough 58 still open for water to enter through. This ensures that flap 54 never completely closes which would cause valve 20 to stick open. If the tank is practically empty and plate 34 is out of the water, the adhesive property of moisture left on flap 54 can cause it to stick to plate 34. Trough 58 still lets water into chamber 40 so that valve 20 does not stick open.

Sides 38 have a very flexible shape to allow delayer 32 to contract and expand from the light forces on it. The cross section of sides 38 has a width when contracted (FIGS. 2 & 3) which is almost equal to its height when expanded (FIG. 1). Also the cross section has a curved shape as shown in FIG. 2 which partially straightens as delayer 32 expands. This allows sides 38 to bend rather than stretch when chamber 40 expands. Bending of a thin surface requires much less force than does stretching. Sides 38 do not pull inner circumference 42 (FIG. 5) outward a significant amount when delayer 32 expands. That would cause inner circumference 42 to stretch.

Chamber 40 must not be able to lengthen without increasing in volume. That would permit valve 20 to quickly drop without sucking water in through control opening 52. The curved cross section of sides 38 in FIGS. 2 & 3 give the minimum volume in chamber 40 for the length of the cross section. Sides 38 can not reshape as delayer 32 lengthens to take up more volume in chamber 40. Sides 38 are made thick enough that they do not stretch inward significantly to fill the vacuum inside chamber 40. Non-stretch strings can be embedded in sides 38 running from plate 34 to valve stiffener 36 to further prevent stretching.

Adjustment screw 50 limits how far delayer 32 can contract. When it is less contracted it requires less time to expand. Less water then flows under valve 20 to refill the bowl.

Conclusion, Ramifications and Scope of Invention

Thus the objects and advantages cited above have clearly been met by this invention as follows:

The delayer holds the valve slightly open for a few seconds to refill the toilet bowl. This helps water-saving valves save more water. It also makes water saving valves more likely to be installed and used.

This device is small, compact, and lightweight. This allows it to be easily installed on a water-saving valve without interfering with the operation of the valve.

The delayer can be made of plastic and rubber or vinyl. It has very few parts, making it very dependable, yet inexpensive.

This device has nothing to cause it to stick and hold the valve open indefinitely. It is unlikely to cause leaks or malfunction.

This device requires no manual operation other than the normal operation of the water-saving valve.

This device can be sold attached to the water-saving device, so that it requires no additional effort or skill to install.

This device can be adjusted for each particular toilet.

The delayer can be used with or without the usual refill hose and adjusted accordingly.

The above description contains many specific items, but these should not be construed to limit the scope of the invention. They are only samples of some preferred embodiments. Many other variations are possible. For example:

Other ways are possible to sustain valve 20 and plate 34 in an open position. A float can be on the bottom of valve 20 which lets air bubble out at a predetermined rate.

A second dashpot can be connected to valve 20. A float can be connected at the flush handle.

The delayer can be located at other locations, as shown in the inventor's original patent.

A delayer can be used above valve 20 that compresses as valve 20 completely closes.

A delayer can comprise a piston that moves through a cylinder.

Sides 38 can be replaced with a bellows having several folds.

Valve 20 does not have to hinge with arms 44 or plate 34. Elasticity of sides 38 and weights or floats can contract delayer 32. Tabs 68 and carriage 60 can support plate 34 in its first position.

Valve 20 can hinge to plate 34 at other locations. Weights on valve 20 can use leverage to contract delayer.

Valve stiffener 36 can be replaced with ribs molded across the bottom of valve 20 within outlet 22.

Other types of control openings are possible, such as ball valves, guided-head valves, or a slit between elastomeric flanges.

Flap 54 can have various designs to prevent it from sticking shut and to make valve 20 close at the right speed for both short and long flushes. Its thickness, shape, elasticity, and attachment to plate 34, and trough 58 size can all be varied to effect its performance.

If flap 54 is stiff enough it will not close at all during the long flush and the bowl will be refilled via the conventional refill hose. Delayer 32 will only assist refilling during the short flush.

I claim:

1. A valve assembly for a toilet having a flush tank with an outlet, said valve assembly comprising a) a valve that seats on said outlet in a closed position, said valve having an open position which allows a fast flow of water through said outlet, and a slightly-open position which allows a substantially slower flow of water through said outlet, b) sustaining means for sustaining said valve in said open position until water in said tank has partially drained to a predetermined level, whereupon said sustaining means then allows said valve to quickly drop to said slightly-open position, c) a delayer comprised of an envelope forming a water-tight chamber, said envelope having an end attached to said valve and an opposite end attached to an arm, said delayer and said arm moving freely with said valve as said valve opens and as said valve doses to said slightly-open position, said arm contacting a support means when said valve reaches said slightly-open position while closing, preventing farther movement of said arm and said opposite end, said valve causing said chamber to then alter from a first volume to a second volume as said valve closes from said slightly-open position to seat on said outlet, d) a relief opening which allows water to flow freely through said envelope as said chamber returns to said first volume, and e) a control opening which controls the rate of water flow through said envelope as said chamber alters to said second volume, whereby said sustaining means allows a predetermined amount of water to flow quickly through said outlet to flush said toilet and said control opening controls the rate at which said chamber alters to said second volume, thus controlling the rate at which said valve closes from said slightly-open position, allowing a smaller predetermined amount of water to flow through said outlet to refill the bowl of the said toilet.

2. The valve assembly of claim 1, wherein sides of said chamber comprise flexible material extending between opposite ends of said chamber, said sides having a curved cross section when said chamber is contracted which is nearly as wide as the distance between said opposite ends when said chamber is expanded.

3. The valve assembly of claim 1, wherein said control opening also serves as said relief opening.

4. The valve assembly of claim 1, wherein increased water pressure on said control opening decreases the size of said control opening, whereby the rate of water flow through said envelope remains somewhat constant for varying water pressures.

5. The valve assembly of claim 4, wherein said control opening comprises an elastomeric flap attached to a plate which forms a part of said envelope, said flap extending over a hole in said plate and said flap having a shallow trough of predetermined size in its side which presses against said plate.

6. A valve assembly for a flush tank with an outlet, said valve assembly comprising, a) a plate rotably connected along an axis in said flush tank, said plate rotating between a first position a short distance above said outlet and a second position considerably farther above said outlet, b) support means to prevent said plate from rotating below said first position, c) a valve that seats on said outlet in a closed position, and rotates around said axis with said plate to an open position as said plate rotates to said second position, d) a sustaining means for sustaining said plate in said second position and said valve in said open position until water in said tank has drained to a predetermined level, e) an envelope forming a chamber having an end attached to said plate and an opposite end attached to said valve, said chamber alternating between a first volume when said valve is adjacent said pate and send volume when said valve is in said closed position and said plate is in said first position, and f) a control opening in said chamber which controls the rate of water flow through said envelope as said chamber alters to said second volume, whereby when said plate is in said second position a large quantity of water flows through said outlet for flushing until said plate drops to said first position where said control opening controls the rate at which said chamber alters to said second volume, which controls the rate of final closing of said valve, allowing a predetermined smaller quantity of water to flow through said outlet for refilling a toilet bowl.

7. The valve assembly of claim 6, wherein said valve is rotably attached to said plate, whereby said outlet said valve and said axis comprise said support means and water flow around said valve cause said chamber to remain at said first volume until said plate reaches said first position.

8. The valve assembly of claim 6, wherein said end is integral with said plate and said opposite end is integral with said valve.

* * * * *